US010399725B2

(12) United States Patent
Paz

(10) Patent No.: US 10,399,725 B2
(45) Date of Patent: Sep. 3, 2019

(54) MEDICATION DISPENSER

(71) Applicant: P.C.O.A. Devices Ltd., Tel Aviv (IL)

(72) Inventor: Ilan Paz, Gush Etzion (IL)

(73) Assignee: P.C.O.A. Devices LTD., Tel Aviv (IL)

( * ) Notice: Subject to any disclaimer, the term of this patent is extended or adjusted under 35 U.S.C. 154(b) by 224 days.

(21) Appl. No.: 14/412,836

(22) PCT Filed: Jul. 2, 2013

(86) PCT No.: PCT/IL2013/050568
§ 371 (c)(1),
(2) Date: Jan. 5, 2015

(87) PCT Pub. No.: WO2014/006620
PCT Pub. Date: Jan. 9, 2014

(65) Prior Publication Data

US 2015/0191268 A1 Jul. 9, 2015

(30) Foreign Application Priority Data

Jul. 5, 2012 (IL) ..... 220794
Jun. 18, 2013 (IL) ..... 227027

(51) Int. Cl.
*B65B 69/00* (2006.01)
*A61J 1/03* (2006.01)
(Continued)

(52) U.S. Cl.
CPC ..... *B65B 69/0058* (2013.01); *A61J 7/0076* (2013.01); *A61J 7/0472* (2013.01); *A61J 1/035* (2013.01); *A61J 7/04* (2013.01)

(58) Field of Classification Search
CPC ..... A61J 1/035; A61J 7/0084; A61J 7/0436; A61J 7/0481; B65B 69/0058; B65D 83/0463
See application file for complete search history.

(56) References Cited

U.S. PATENT DOCUMENTS 38,343 A 4/1863 Tower
708,216 A 9/1902 Fowler, Jr.
(Continued)

FOREIGN PATENT DOCUMENTS

DE 20210715 8/2003
DE 202006011530 10/2006
(Continued)

OTHER PUBLICATIONS 201380046114.3, Notification of First Office Action with English Translation, dated Dec. 16, 2015, 23 pages.
(Continued)

*Primary Examiner* — Gene O Crawford
*Assistant Examiner* — Kelvin L Randall, Jr.
(74) *Attorney, Agent, or Firm* — Stoel Rives LLP

(57) ABSTRACT

The present invention provides a medication dispenser enabling the controlled sequential delivery of a regimen of pills on an as-needed basis with a predetermined prescribed minimum time interval between delivery of each pill, from any flat multiple pill-containing pack of the blister package type having at least one column of pills to be dispensed, said dispenser comprising: a) an access portal sized to receive at least one any such blister pack and to guide said pack to at least one electromechanical blister pack advancing unit which in turn sequentially advances said pack to a stationary depilling station, said station comprising: i. pill detecting means; ii. a blister pack support having at least one pill receiving aperture, sized and positioned to receive pills of different sizes, shapes and spacing in said blister pack array; and, iii. an electromechanical depilling press means positioned, upon activation, to force at least one pill at a time from its respective blister through the backing of said blister via said aperture as said blister pack is advanced through said stationary depilling station within said dispenser.

6 Claims, 9 Drawing Sheets

(51) Int. Cl.
*A61J 7/04* (2006.01)
*A61J 7/00* (2006.01)

(56) References Cited

U.S. PATENT DOCUMENTS 1,187,634 A 6/1916 Lorimer et al.
2,004,243 A 6/1935 Hloch
2,470,298 A 5/1949 Fields
2,510,712 A 6/1950 Olowinski
2,526,749 A 10/1950 Hokanson
2,694,641 A 11/1954 Atwood
2,701,662 A * 2/1955 Smith ..... G07F 11/045 194/256
2,740,558 A 4/1956 Steele
2,963,200 A 12/1960 Miller
3,150,639 A 9/1964 Sereda
3,270,918 A 9/1966 Burch et al.
RE26,589 E 5/1969 Murov et al.
3,777,742 A 12/1973 Aumiller et al.
3,923,060 A 12/1975 Ellinwood, Jr.
4,106,698 A 8/1978 Lin
4,114,965 A 9/1978 Oye et al.
4,237,884 A 12/1980 Erickson et al.
4,581,013 A 4/1986 Allen
4,695,954 A 9/1987 Rose et al.
4,839,806 A 6/1989 Goldfischer et al.
4,887,594 A 12/1989 Siegel
4,918,690 A 4/1990 Markkula, Jr.
4,981,468 A 1/1991 Benefiel et al.
5,014,040 A 5/1991 Weaver et al.
5,049,125 A 9/1991 Accaries et al.
5,110,008 A 5/1992 Moulding et al.
5,163,426 A 11/1992 Czeisler et al.
5,176,133 A 1/1993 Czeisler et al.
5,219,093 A 6/1993 Moulding et al.
5,344,043 A 9/1994 Moulding et al.
5,431,299 A 7/1995 Brewer et al.
5,460,299 A 10/1995 Prause
5,475,687 A 12/1995 Markkula, Jr. et al.
5,490,610 A 2/1996 Pearson
5,524,073 A 6/1996 Stambler
5,562,232 A 10/1996 Pearson
5,718,681 A 2/1998 Manning
5,844,888 A 12/1998 Markkula, Jr.
5,850,937 A 12/1998 Rauche
5,853,244 A 12/1998 Hoff et al.
5,955,952 A 9/1999 Bergman et al.
6,021,918 A 2/2000 Dumont et al.
6,024,247 A * 2/2000 Birr ..... B65B 69/0058 221/26
6,032,155 A 2/2000 De La
6,048,271 A 4/2000 Barcelou
6,068,126 A 5/2000 Dejonge
6,145,697 A 11/2000 Gudish
6,150,942 A 11/2000 O'Brien et al.
6,152,364 A 11/2000 Schoonen et al.
6,163,736 A 12/2000 Halfare
6,219,587 B1 4/2001 Arlin et al.
6,234,343 B1 5/2001 Papp
6,263,259 B1 7/2001 Bartur
6,304,797 B1 10/2001 Shusterman
6,318,051 B1 11/2001 Preiss
6,327,570 B1 12/2001 Stevens
6,352,200 B1 3/2002 Schoonen et al.
6,415,202 B1 7/2002 Halfacre
6,529,446 B1 3/2003 De La Huerga
6,579,231 B1 6/2003 Phipps
6,601,729 B1 8/2003 Papp
6,604,019 B2 8/2003 Ahlin et al.
6,611,733 B1 8/2003 De La
6,648,848 B1 11/2003 Keldmann et al.
6,729,327 B2 5/2004 McFarland, Jr. et al.
6,766,219 B1 7/2004 Hasey
6,776,304 B2 8/2004 Liff et al.
6,814,255 B2 11/2004 Liff et al.
6,848,593 B2 2/2005 Papp
6,892,941 B2 5/2005 Rosenblum
6,922,664 B1 7/2005 Fernandez et al.
6,947,900 B2 9/2005 Giordano, III et al.
6,988,634 B2 1/2006 Varis
7,006,894 B2 2/2006 De La
7,030,823 B2 4/2006 Apothéloz et al.
7,044,302 B2 5/2006 Conley
7,051,898 B1 5/2006 Connell
7,084,946 B2 8/2006 Ota et al.
7,178,688 B2 2/2007 Naufel et al.
7,216,776 B2 5/2007 Gelardi
7,216,802 B1 5/2007 De La Huerga
7,231,920 B2 6/2007 Harvey et al.
7,302,311 B2 11/2007 Varis
7,359,765 B2 4/2008 Varvarelis et al.
7,426,475 B1 9/2008 Tangellapally et al.
7,451,761 B2 11/2008 Hickey et al.
7,491,219 B2 2/2009 Steinberg
7,503,081 B2 3/2009 Montgomery
7,624,733 B2 12/2009 Riley et al.
7,624,894 B2 12/2009 Gerold et al.
7,637,079 B2 12/2009 Klingel et al.
7,654,261 B1 2/2010 Rockhold
7,665,811 B2 2/2010 Johanning
7,677,941 B2 3/2010 Koyama
7,692,195 B2 4/2010 Namose
7,704,236 B2 4/2010 Denolly
7,727,469 B2 6/2010 Takahashi et al.
7,743,923 B2 6/2010 Conley
7,766,365 B2 8/2010 Darling, III
7,771,984 B2 8/2010 Dzekunov et al.
7,787,986 B2 8/2010 Pinney et al.
7,828,147 B2 11/2010 Caracciolo et al.
7,844,362 B2 11/2010 Handfield et al.
7,860,724 B2 12/2010 Chudy et al.
7,865,263 B2 1/2011 Span, Jr. et al.
7,885,725 B2 2/2011 Dunn
7,896,192 B2 3/2011 Conley et al.
7,930,056 B2 4/2011 Fernandez
7,932,832 B2 4/2011 Hayashi
7,934,355 B2 5/2011 Strub et al.
7,946,483 B2 5/2011 Miller et al.
7,978,083 B2 7/2011 Melker et al.
7,988,016 B2 8/2011 Klein et al.
7,996,106 B2 8/2011 Ervin
7,999,987 B2 8/2011 Namose
8,006,903 B2 8/2011 Braun
8,015,417 B2 9/2011 Kato et al.
8,027,748 B2 9/2011 Handfield et al.
8,032,397 B2 10/2011 Lawless
8,065,035 B2 11/2011 Ross et al.
8,073,563 B2 12/2011 Vahlberg et al.
8,090,473 B2 1/2012 Higham
8,103,346 B2 1/2012 Mass et al.
8,103,379 B2 1/2012 Biba et al.
8,112,942 B2 2/2012 Bohm et al.
8,118,222 B2 2/2012 Barcelou
8,126,590 B2 2/2012 Vahlberg et al.
8,135,497 B2 3/2012 Joslyn
8,140,186 B2 3/2012 Vahlberg et al.
8,145,353 B1 3/2012 Cotner
8,162,690 B2 4/2012 Smith
8,195,329 B2 6/2012 Pinney et al.
8,265,757 B2 9/2012 Mass et al.
8,266,447 B2 9/2012 Völkening et al.
8,280,550 B2 10/2012 Levy et al.
8,343,434 B2 1/2013 Hyde et al.
8,390,761 B2 3/2013 Oda
8,395,314 B2 3/2013 Yamamoto et al.
8,417,378 B2 4/2013 Joslyn
8,468,031 B2 6/2013 Jung et al.
8,478,604 B2 7/2013 Henderson et al.
8,494,878 B2 7/2013 Stevens
8,504,197 B2 8/2013 Farr
8,554,365 B2 10/2013 Thomas et al.
8,587,427 B2 11/2013 Lalonde et al.
8,615,971 B2 12/2013 Freudelsperger
8,626,342 B2 1/2014 Williams

(56) References Cited

U.S. PATENT DOCUMENTS 8,672,879 B2 3/2014 Grant et al.
8,725,291 B2 5/2014 Czaja et al.
8,787,555 B2 7/2014 Gonen et al.
8,926,526 B2 1/2015 Shuck
8,930,207 B2 1/2015 Keravich et al.
8,931,634 B2 1/2015 Anderson
8,954,190 B2 2/2015 Braunstein
9,014,847 B2 4/2015 Dunn
9,031,690 B2 5/2015 Cotner
9,037,616 B2 5/2015 Bessette
9,043,012 B2 5/2015 Davey et al.
9,098,983 B2 8/2015 Rahilly
9,107,571 B2 8/2015 Strauss et al.
9,111,408 B2 8/2015 Biba et al.
9,185,501 B2 11/2015 Pai
9,211,498 B2 12/2015 Akdogan et al.
9,235,689 B2 1/2016 Ervin
9,242,043 B2 1/2016 Ludolph
9,245,305 B2 1/2016 Wellington et al.
9,358,499 B2 6/2016 Akdogan et al.
9,358,500 B2 6/2016 Akdogan et al.
9,361,748 B2 6/2016 Cunningham et al.
9,381,311 B2 7/2016 Holakovsky et al.
9,387,153 B1* 7/2016 Mazur ..... A61J 7/0069
9,400,873 B2 7/2016 Kamen et al.
9,443,062 B2 9/2016 Long et al.
9,463,412 B2 10/2016 Akdogan et al.
9,465,919 B2 10/2016 Kamen et al.
9,508,935 B2 11/2016 Watanabe
9,550,031 B2 1/2017 Van Sickle et al.
9,561,324 B2 2/2017 Estes
9,600,635 B2 3/2017 Czaja
9,665,689 B2 5/2017 O'Brien et al.
9,675,523 B2 6/2017 Ducatt et al.
9,707,358 B2 7/2017 Eggert et al.
9,730,005 B2 8/2017 Pai
2002/0026332 A1 2/2002 Snowden et al.
2002/0034978 A1 3/2002 Legge et al.
2002/0088825 A1 7/2002 Laverdure
2002/0165641 A1 11/2002 Manalang et al.
2002/0189684 A1 12/2002 Williamson et al.
2003/0029880 A1* 2/2003 Hunts ..... B65B 69/0058 221/25
2003/0042167 A1* 3/2003 Balz ..... B65D 83/0463 206/531
2003/0115082 A1 6/2003 Jacobsen et al.
2003/0216625 A1 11/2003 Phipps
2004/0019502 A1 1/2004 Leaman
2004/0045858 A1 3/2004 Harrold
2004/0073454 A1 4/2004 Urquhart et al.
2004/0077937 A1 4/2004 Yarden
2004/0139000 A1 7/2004 Amos
2004/0158350 A1* 8/2004 Ostergaard ..... A61J 7/0481 700/231
2004/0158507 A1 8/2004 Meek et al.
2004/0244794 A1 12/2004 Richards
2004/0249250 A1 12/2004 McGee et al.
2005/0043965 A1 2/2005 Heller et al.
2005/0109858 A1 5/2005 Sedaghat Kerdar
2005/0211768 A1 9/2005 Stillman
2006/0104765 A1* 5/2006 Yuyama ..... B65B 69/0058 414/412
2006/0125356 A1 6/2006 Meek, Jr. et al.
2006/0154642 A1 7/2006 Scannell, Jr.
2006/0184524 A1 8/2006 Pollanz
2006/0194075 A1 8/2006 Miyamoto et al.
2006/0204922 A1 9/2006 Anderson et al.
2007/0042488 A1 2/2007 Bornemann
2007/0051072 A1 3/2007 Lai
2007/0104731 A1 5/2007 Kelleher et al.
2007/0185614 A1 8/2007 Bain
2007/0197978 A1 8/2007 Wortham
2007/0213877 A1 9/2007 Hart et al.
2007/0222554 A1 9/2007 Hart
2007/0261985 A1 11/2007 Allen
2008/0004507 A1 1/2008 Williams et al.
2008/0035520 A1* 2/2008 Caracciolo ..... G06F 19/3462 206/531
2008/0164275 A1 7/2008 Poutiatine et al.
2008/0179387 A1 7/2008 Cantlay et al.
2008/0189173 A1 8/2008 Bakar et al.
2008/0251551 A1 10/2008 Huber et al.
2008/0257904 A1* 10/2008 Schiff ..... B65B 69/0058 221/74
2008/0283542 A1 11/2008 Lanka et al.
2009/0024248 A1 1/2009 Hodson
2009/0055223 A1 2/2009 Jung et al.
2009/0073356 A1 3/2009 Moriyama et al.
2009/0079335 A1 3/2009 Mitsuya et al.
2009/0134368 A1 5/2009 Shibatani et al.
2009/0135120 A1 5/2009 Shibatani
2009/0135349 A1 5/2009 Shibatani et al.
2009/0138122 A1* 5/2009 Wagner ..... G06F 19/327 700/226
2009/0152514 A1 6/2009 Takiguchi et al.
2009/0152516 A1 6/2009 Shibatani et al.
2009/0152518 A1 6/2009 Takiguchi et al.
2009/0185114 A1 7/2009 Takiguchi
2009/0189128 A1 7/2009 Takiguchi et al.
2009/0230164 A1 9/2009 Freeman
2009/0240528 A1 9/2009 Bluth
2009/0250485 A1* 10/2009 Klingel ..... B65B 5/103 221/31
2009/0299522 A1 12/2009 Savir et al.
2009/0302048 A1 12/2009 Nobilet et al.
2010/0005445 A1 1/2010 Argue et al.
2010/0016746 A1 1/2010 Hampton et al.
2010/0041056 A1 2/2010 Kinnon et al.
2010/0100237 A1* 4/2010 Ratnakar ..... A61J 7/02 700/232
2010/0205009 A1 8/2010 Kostoff
2010/0237338 A1 9/2010 Yamamoto et al.
2010/0250697 A1 9/2010 Hansen et al.
2010/0294927 A1 11/2010 Nelson et al.
2010/0312137 A1 12/2010 Gilmour et al.
2011/0014351 A1 1/2011 Reider et al.
2011/0130635 A1 6/2011 Ross
2011/0173028 A1 7/2011 Bond
2011/0190635 A1 8/2011 Bosler
2011/0270442 A1 11/2011 Conley et al.
2012/0003928 A1 1/2012 Geboers
2012/0066097 A1 3/2012 Amos
2013/0018356 A1 1/2013 Prince
2013/0027206 A1 1/2013 Kosted
2013/0046276 A1 2/2013 Mernoe et al.
2013/0070090 A1 3/2013 Bufalini et al.
2013/0090744 A1 4/2013 Tran
2013/0104284 A1 5/2013 Kantrowitz et al.
2013/0151267 A1 6/2013 Mehdizadeh et al.
2013/0173302 A1 7/2013 Hyde et al.
2013/0231954 A1 9/2013 Bryant
2013/0234855 A1 9/2013 Knighton
2013/0290115 A1 10/2013 Leoni et al.
2013/0297068 A1 11/2013 Marshall
2013/0310664 A1 11/2013 Kozloski et al.
2013/0317835 A1 11/2013 Mathew
2014/0177825 A1 6/2014 Mattsson et al.
2014/0241838 A1* 8/2014 Beck ..... B65B 69/0058 414/412
2014/0241839 A1* 8/2014 Beck ..... B65B 69/0058 414/412
2014/0277136 A1 9/2014 Stein
2014/0320289 A1 10/2014 Raichman
2015/0057574 A1 2/2015 Baym et al.
2015/0058041 A1 2/2015 Ervin
2015/0081330 A1 3/2015 Mann et al.
2015/0083742 A1* 3/2015 Choi ..... B65B 69/0058 221/7
2015/0148943 A1 5/2015 Sullivan
2015/0191294 A1* 7/2015 Paz ..... A61J 7/0076 221/9
2015/0374441 A1 12/2015 Machado et al.
2016/0012445 A1 1/2016 Villa-Real

(56) References Cited

U.S. PATENT DOCUMENTS

| | | | |
|---|---|---|---|
| 2016/0066855 | A1 | 3/2016 | Hyde et al. |
| 2016/0068329 | A1* | 3/2016 | Uno ..... B65B 69/0058 221/186 |
| 2016/0089303 | A1 | 3/2016 | Latorraca et al. |
| 2016/0089491 | A1 | 3/2016 | Smith |
| 2016/0158465 | A1 | 6/2016 | Coats et al. |
| 2016/0210439 | A1 | 7/2016 | Hartlaub et al. |
| 2016/0259183 | A1 | 9/2016 | Rayner |
| 2016/0267229 | A1 | 9/2016 | High et al. |
| 2016/0283691 | A1 | 9/2016 | Ali |
| 2016/0314272 | A1 | 10/2016 | Braustein |
| 2016/0331641 | A1 | 11/2016 | Longley et al. |
| 2016/0346056 | A1 | 12/2016 | Demers et al. |
| 2016/0350500 | A1 | 12/2016 | Benja-Athon |
| 2016/0354284 | A1 | 12/2016 | Liou et al. |
| 2016/0367188 | A1 | 12/2016 | Malik et al. |
| 2016/0367421 | A1 | 12/2016 | Ead |
| 2016/0374902 | A1 | 12/2016 | Govindasamy |
| 2017/0020785 | A1 | 1/2017 | McCullough |
| 2017/0032092 | A1 | 2/2017 | Mink et al. |
| 2017/0043896 | A1 | 2/2017 | Fernandez |
| 2017/0231870 | A1 | 8/2017 | Stachler et al. |

FOREIGN PATENT DOCUMENTS

| | | | |
|---|---|---|---|
| EP | 0869079 | | 10/1998 |
| EP | 1721596 | B1 | 12/2009 |
| EP | 2301850 | | 3/2011 |
| JP | 2006052019 | A | 2/2006 |
| WO | 1992020455 | A1 | 11/1992 |
| WO | 1996013790 | A1 | 5/1996 |
| WO | 97/08078 | A1 | 3/1997 |
| WO | 199910830 | A1 | 3/1999 |
| WO | 2000064754 | A1 | 11/2000 |
| WO | 2001067345 | A1 | 9/2001 |
| WO | 2001076460 | A2 | 10/2001 |
| WO | 2002071955 | A2 | 9/2002 |
| WO | 2002095645 | A1 | 11/2002 |
| WO | 2003040686 | A2 | 5/2003 |
| WO | 2005109119 | A1 | 11/2005 |
| WO | 2007070570 | A2 | 6/2007 |
| WO | 2009036316 | A1 | 3/2009 |
| WO | 2010008377 | A1 | 1/2010 |
| WO | 2011002319 | A2 | 1/2011 |
| WO | 2011023941 | | 3/2011 |
| WO | 2011023941 | A2 | 3/2011 |
| WO | 2011055040 | A1 | 5/2011 |
| WO | 2011151056 | A1 | 12/2011 |
| WO | 2012040528 | A1 | 3/2012 |
| WO | 2012066580 | A2 | 5/2012 |
| WO | 2012069896 | A1 | 5/2012 |
| WO | 2012098248 | A2 | 7/2012 |
| WO | 2012098249 | A1 | 7/2012 |
| WO | 2014059310 | A2 | 4/2014 |
| WO | 2014144548 | A2 | 9/2014 |
| WO | 2015016375 | A1 | 2/2015 |
| WO | 2015113149 | A1 | 8/2015 |
| WO | 2015117049 | A2 | 8/2015 |
| WO | 2015196293 | A1 | 12/2015 |
| WO | 2016030902 | A1 | 3/2016 |
| WO | 2016103256 | A1 | 6/2016 |
| WO | 2016137186 | A1 | 9/2016 |
| WO | 2016155970 | A1 | 10/2016 |
| WO | 2016181014 | A1 | 11/2016 |
| WO | 2016189497 | A1 | 12/2016 |
| WO | 2016196102 | A1 | 12/2016 |
| WO | 2017055728 | A2 | 4/2017 |

OTHER PUBLICATIONS

U.S. Appl. No. 14/418,149, Non-Final Office Action, dated Jun. 16, 2016, 14 pages.

International Search Report issued in PCT/IL2013/050631 dated Feb. 21, 2014.

Written Opinion of the International Searching Authority issued in PCT/IL/2013/050631 dated Feb. 21, 2014.

International Search Report issued in PCT/IL2013/050568 dated Nov. 25, 2013.

Written Opinion of the International Searching Authority issued in PCT/IL/2013/050568 dated Nov. 25, 2013.

U.S. Appl. No. 14/418,149, Final Office Action, dated Feb. 28, 2017, 20 pages.

* cited by examiner

MEDICATION DISPENSER

CROSS-REFERENCE TO RELATED APPLICATIONS

This application claims the benefit of a national stage application under 35 U.S.C. § 371 of International Application No. PCT/IL2013/050568, titled MEDICATION DISPENSER, filed Jul. 2, 2013, which claims priority to Israel Patent Application No. 227027, filed Jun. 18, 2013 and Israel Patent Application No. 220794, filed Jul. 5, 2012, all of which are hereby incorporated by reference in their entireties.

FIELD OF THE INVENTION

The present invention relates to the field of controlled medication administration. More particularly, the present invention relates to medication dispensers. Even more particularly the present invention relates to blister pack pill dispensers.

BACKGROUND OF THE INVENTION

When hospital patients are supposed to take medication they generally require a nurse or other staff member to provide the medication to them. Typically, either the patient will call the nurse or the nurse will go to the patient in order to administer the medication. The nurse must first confirm, among other things, that it is the proper time to administer the medication, that the correct dosage is present, that the patient did not receive the medication from someone else, etc. After going through the details of the patient as listed on his chart the nurse may then administer the medication.

When the medication is a controlled drug, such as a strong analgesic, government regulations specify certain protocols, including detailed record keeping and accounting of each dosage of the drugs that the hospital possesses. Thus, following the confirmation of all the prerequisites for administering a medication, if the medication is a controlled drug the nurse must then proceed to sign the drug out from its stored location and return to the patient to administer the drug.

Although some medications require the nurse to perform the actual administration, a pill may be ingested by the patient using his own faculties. Nevertheless, the nurse must still spend valuable time going from one patient to the next in order to simply hand over a pill. It is not feasible to leave a plurality of pills with the patient and allow him to ingest, for instance an analgesic pill, by himself since he may become addicted to the medication and take more pills than he is allowed.

Nurses are often busy with other activities and cannot always tend to the administration of patients' medications at the precise moment that the medication should be given. Delays in administering the medication could result in a high cost to the patient by potentially worsening the patient's condition, as well as high costs to the hospital by preventing a patient from recovering quickly, thereby requiring additional outlay of monies toward medication and other hospital upkeep for the patient.

Several prior art solutions to the above-mentioned problems have been suggested, however, they all have difficulties and drawbacks associated with them.

U.S. Pat. No. 7,896,192 to Conley et al. discloses a medication dispenser for permitting access to medication doses after a minimum dosing interval between doses. The dispenser comprises a medication tray comprising medication retention areas and blank areas. A medication dose is disposed in each retention area. A cover is disposed over the medication tray, the cover defining a dose opening through which a dose in a retention area can be accessed. A controller authenticates a person to access a medication dose. The controller further aligns the dose opening with a retention area to present a medication dose through the dose opening after the minimum dosing interval has elapsed and the person has been authenticated, and wherein the controller aligns the dose opening with a blank area between minimum dosing intervals.

In order to operate the device described in Conley et al. authorized medical personal is required to manually remove the drug from the packaging and place each dosage in the retention area prior to use. This in itself is a time consuming procedure but also has the disadvantages that the pills lay open after the removal of the protective coating of the blister pack and can be affected by humidity which can lead to moisture expansion Also there is a risk of abrasion of drugs during handling or even of partial crushing thereof. Thus, unused dosages that are left over after the patient no longer requires the drug are often considered contaminated and often must be disposed of. Alternatively, if reuse of unused pills is contemplated then regulations usually require a pharmacy on the site of usage, which pharmacy must be willing to provide a service of re-blistering of drugs after the examination of each pill for defects. Usually however this is usually not practical or legal. Besides the losses caused by the disposal of the unused dosages, proper protocol requires controlled drugs to be returned to their storage location, however, due to contamination this is not possible and proper record keeping cannot be followed.

U.S. Pat. No. 6,766,219 to Hasey discloses a medication dispensing cassette comprising a housing for enclosing at least one continuous track having a plurality of receptacles for medication, wherein each receptacle accommodates one dosage of medication. An electrical drive mechanism drives the track. A pill tray receives pills dispensed from the cassette through a pill dispensing port. A lid is attached to the housing, located above the pill tray, and is openable for removal of pills.

Hasey's device requires a unique cassette manufactured specifically for the device. This alone is undesirable as it increases costs of drug manufacturers by requiring expenditure on new machinery for producing the cassette instead of relying on the already tried and true blister pack for keeping the drug in an uncontaminated environment. Moreover, the device comprises a manual drive wheel for enabling the user to manually rotate the track. When dealing with addictive analgesic drugs it is hazardous to allow the patient to control the dispensing of the drug by himself.

DE 10236909 to Udo discloses a dispenser for pills in a blister pack, having upper and lower sections between which the blister pack is disposed. Pills are positioned such that a push button dispenses pills through apertures in the upper section. Contacts on the button and around the apertures produce a signal to change the display when a pill is dispensed.

Although the device disclosed by Udo maintains left over pills in an uncontaminated state, the device does not prevent the user from removing additional pills whenever desired. This allows a potential dangerous situation to arise, wherein the patient may overdose on the drug, similar to the manner described above regarding Hasey's device.

WO 2011023941 to Sanjeet discloses a motorized deblistering dispenser for dispensing e.g. tablets, from blister packs to a patient, having a programmable control unit for controlling the operation of dispensing platforms so that one or more items are dispensed from one or more platforms.

The object of the Sanjeet's dispenser is to provide a motorized deblistering dispenser for personal use by a patient, that is capable of dispensing deblistered items from blister packs of different sizes and configurations in predetermined doses at predetermined times. In a hospital setting, where controlled drugs are required to be monitored and recorded, Sanjeet's device would be impractical since the patient or others may access the controlled drug without permission.

US 2005/0252924 to Pieper et al. discloses an apparatus for dispensing tablets, also in the form of pills, dragees or the like, having means for holding a blister pack, means for pushing out a tablet from the blister pack and also means for setting taking times and means for displaying taking times. The invention provides for the apparatus to have a bottom part and a lid removably connected to the bottom part for holding the blister pack and also having means for pushing out the tablets from the blister pack, the arrangement of the means being matched to the arrangement of the tablets in the blister pack which is to be held.

The apparatus of Pieper et al. is a manual dispenser which would require the nurse or other hospital staff to dedicate their time at regular intervals to administering the medication to the patient. Moreover, the patient himself has the ability to control the dispensing of the drug, which is undesirable, particularly when dealing with controlled drugs, as described above.

Accordingly, it is a principal object of the present invention to provide a medication dispenser which overcomes the difficulties and drawbacks associated with the prior art as described in part herein above.

It is another object of the present invention to provide a medication dispenser that prevents contamination of the drug prior to reaching the patient, by leaving the drug within its original packaging until immediately prior to administering to the patient, thereby enabling storage and reuse of leftover drugs for a subsequent patient.

It is yet another object of the present invention to provide a medication dispenser that prevents the patient from accessing the drug unless dispensed by the dispenser.

It is a further object of the present invention to provide a medication dispenser that avoids the necessity for requiring interaction by medical staff or anyone other than the patient from the time of calibrating the device until the dosage is complete or the patient no longer needs the medication.

It is yet a further object of the present invention to provide a medication dispenser that enables the controlled sequential delivery of a regimen of pills on an as-needed basis with a predetermined prescribed minimum time interval between delivery of each pill.

Additional objects and advantages of the invention will become apparent as the description proceeds.

SUMMARY OF THE INVENTION

In accordance with a preferred embodiment of the present invention, a medication dispenser is disclosed, which enables the controlled sequential delivery of a regimen of pills on an as-needed basis with a predetermined prescribed minimum time interval between delivery of each pill, from any standard flat multiple pill-containing pack of the blister package type having at least one column of rows of pills to be dispensed, the dispenser comprising:

a. an access portal sized to receive at least one any such blister pack and to guide the pack to at least one electromechanical blister pack advancing unit which in turn sequentially advance the pack to a stationary depilling station, wherein the station comprises:
   i. pill detecting means;
   ii. a blister pack support having at least one pill receiving aperture, sized and positioned to receive pills of different sizes, shapes and spacing in the blister pack array; and,
   iii. electromechanical depilling press means positioned, upon activation, to force at least one pill at a time from its respective blister through the backing of said blister via said aperture as said blister pack is advanced through said stationary depilling station within said dispenser. Optionally, said dispenser further comprises:
b. a channel into which the pill enters from said aperture; and,
c. a dispensing receptacle for receiving the pill from said channel.

Preferably, the access portal is locked upon the complete insertion of the blister pack into the dispenser.

Optionally, said blister pack is a double arrayed blister package type having two columns and a plurality of rows and the depilling station is preferably provided with a pair of spaced apart depilling press means for sequentially dispensing each of the pills in a given row into the aperture positioned therebelow, respectively, before the pack is advanced to position a further row of pills in alignment with the press means and the apertures.

Optionally, the pair of depilling press means are activated by a depilling motor operationally linked thereto such that the motor is programmed to rotate in one direction to activate a first press means to dispense one of the pills and the motor is programmed to rotate in the opposite direction to activate a second press means to dispense another of the pills in the row.

Optionally, the dispenser is provided with guide means for aligning the blister pack as it is advanced by the at least one pair of electromechanical driving wheels to the depilling station. Preferably, the dispenser is provided with at least two guide means for aligning the blister pack as it is advanced by the at least one pair of electromechanical driving wheels to the depilling station. The guide means preferably includes a first guide comprising wheels, which use the two columns of pills themselves for aligning the blister pack as it is advanced and a second guide which interacts with the longitudinal side edges of the blister pack for aligning the blister pack as it is advanced within the dispenser.

In FR 2838047, there is described a system for monitoring the taking of medicines packaged in a blister pack, which comprises optical detection means (5, 20) for determining the contents of cells in the packaging and electromechanical means (21, 22) for extracting the pills from the cell. The means are controlled by an electronic controller (6) that can be linked to a computer (54) for recording times and quantities of medicines taken. A housing (1) is used to contain the pills in their blister pack.

In said patent, however, the blister pack is held stationary and it is the depilling station which moves as opposed to the present invention in which the blister pack is advanced through a stationary depilling station with the advantages described herein.

Furthermore, in said Patent, the pill receiving apertures are specifically sized according to the size and spacing of the pills in the specific type blister pack being processed, and use of a different type of medicine and blister pack requires a reset-up of the system, as opposed to the present dispenser which comprises a blister pack support having two spaced-apart pill receiving apertures, wherein each aperture is sized and positioned to receive pills of different sizes, shapes and spacing in the blister pack array and thus can be used with any standard flat multiple pill-containing pack of the double arrayed blister package type having two columns and a plurality of rows of pills to be dispensed without recalibration or changing of parts.

In preferred embodiments said dispenser is sized to contain, and advance for depilling, more than one standard blister pack.

Thus, e.g., in these embodiments, the dispenser can be sized such that after part of the blister pack has advanced through the depilling station, space is created adjacent the access door for the insertion of a further blister pack by a medical person, so that the patient does not have to worry that their dispenser will run out of pills.

Only when all the pills are deblistered from a specific pack will the empty blister package be advanced far enough within the dispenser to exit the bottom thereof.

Alternatively, in especially preferred embodiments said dispenser is sized to receive, contain and advance for depilling, a cassette containing a plurality of standard blister packs.

The dispensing receptacle is preferably locked to the dispenser and linked to the at least one electromechanical depilling press means, wherein the dispenser can only deliver one pill at a time to the receptacle.

The receptacle is preferably provided with means for detecting that a pill has been removed therefrom, the detecting means being linked to the at least one electromechanical depilling press means for enabling the further activation of the at least one electromechanical depilling press means only after a pill has been removed from the receptacle.

Optionally, the dispensing receptacle is provided in conjunction with an integral housing, which integral housing is lockable to the dispenser, and the integral housing and dispensing receptacle are together disposable, to enable sequential use of the dispenser by multiple sequential patients with a new integral housing and dispensing receptacle attached to the dispenser for each sequential patient.

The integral housing is removable from the dispenser, after locking engagement therewith, by the breaking of the integral housing, thereby rendering the integral housing and dispensing receptacle unsuitable for reuse.

The depilling motor preferably operates in conjunction with a crankshaft apparatus which in turn directs separate up and down motion of each of the pair of depilling press means relative a positioned row of pills in the blister pack.

Preferably, guide means direct up and down motion of the pair of depilling press means relative a positioned row of pills in the blister pack.

Optionally, the medication dispenser comprises an outer housing formed from a split housing having a first and second component interlockable with each other.

To accomplish the above and related objects, the invention may be embodied in the form illustrated in the accompanying drawings. With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show details of the invention in more detail than is necessary for a fundamental understanding of the invention, the description taken with the attached figures making apparent to those skilled in the art how the several forms of the invention may be embodied in practice.

Figure 8:
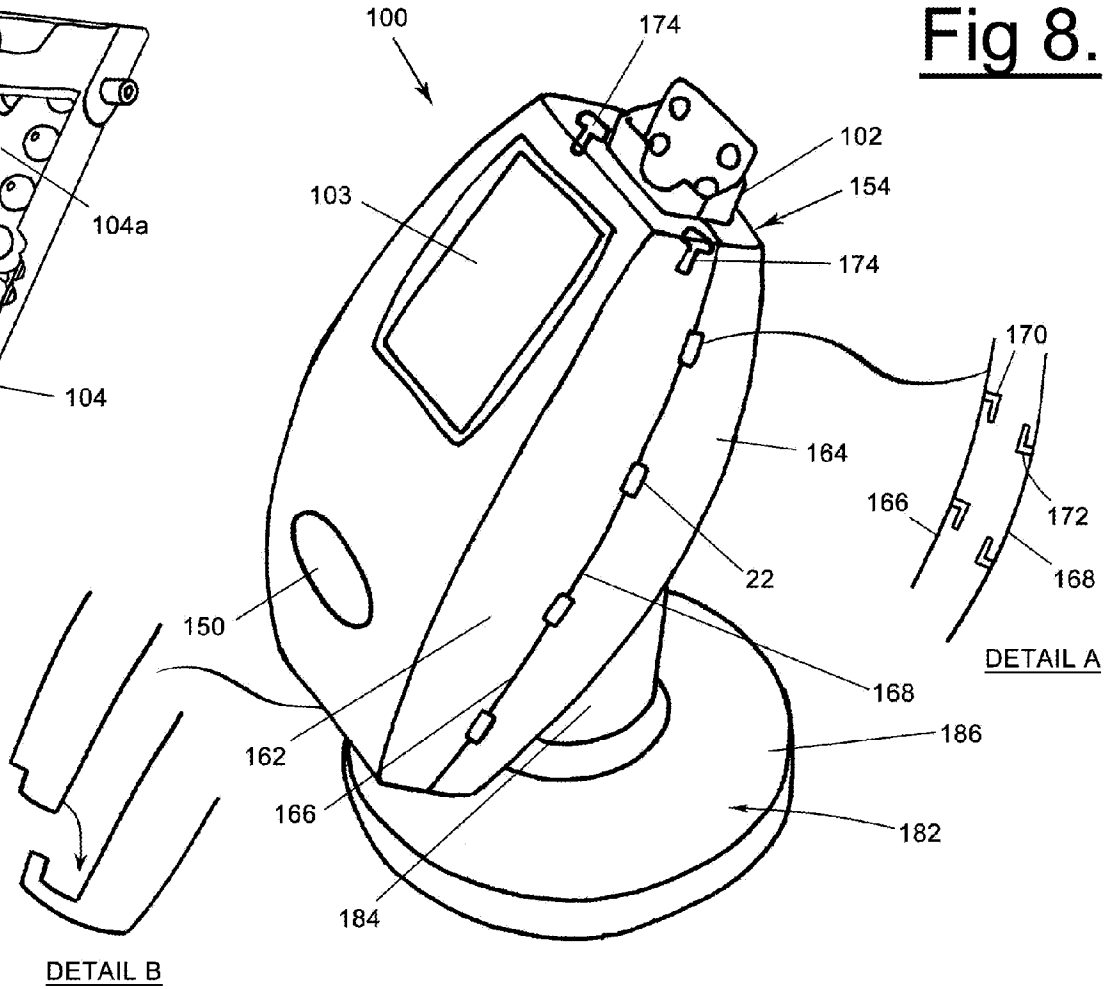
FIG. 8 shows a side perspective view of the assembled dispenser of the present invention.

Detail 8*a* of FIG. 8 is a partial exploded view showing side edges of the split housing of the assembled dispenser and an optional joining configuration thereof;

Detail 8*b* of FIG. 8 is a partial exploded view showing bottom edges of the split housing of the assembled dispenser and optional joining configuration thereof.

Figure 9:
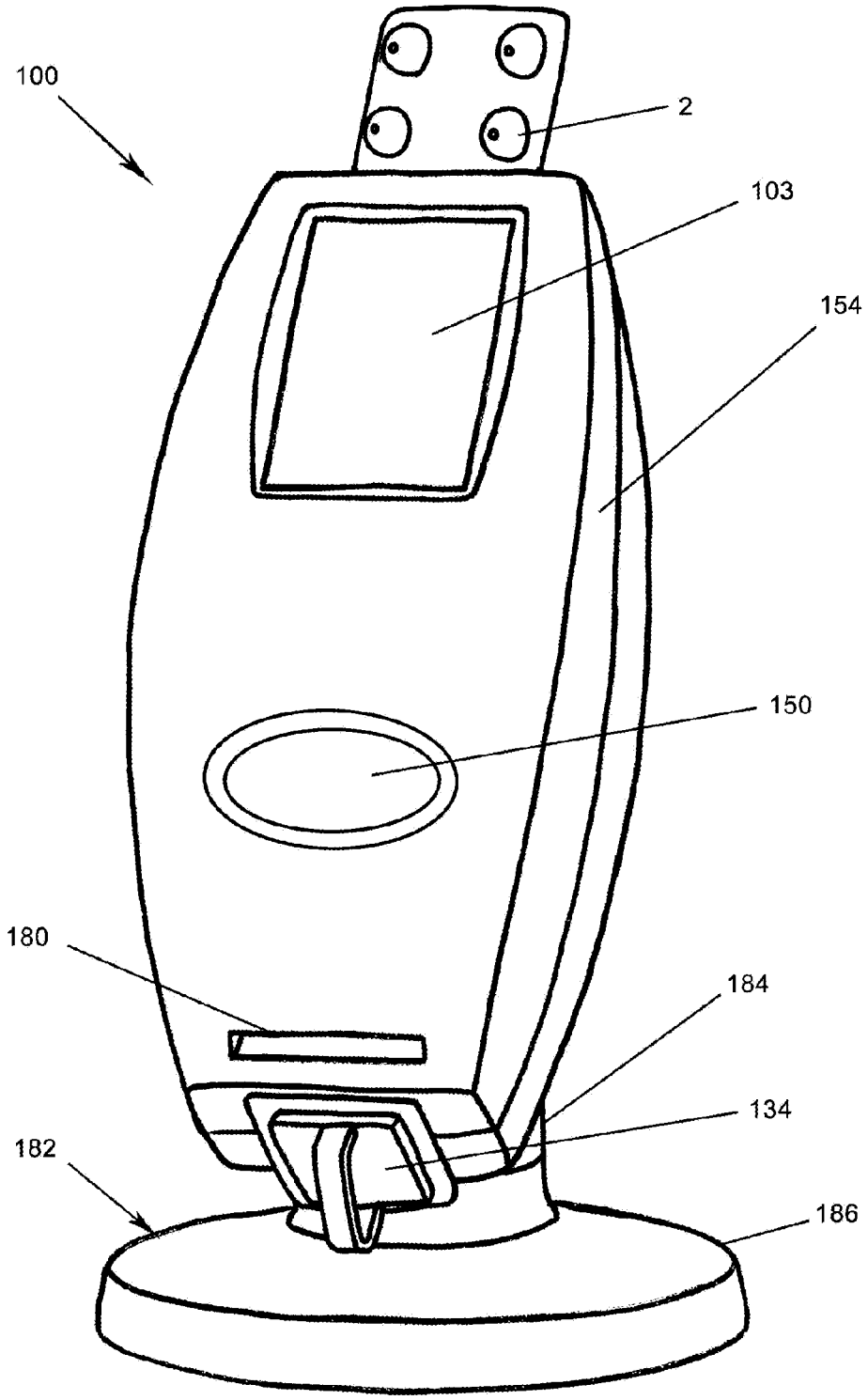

FIG. 9 shows a front perspective view of the assembled dispenser of the present invention.

Figure 11:
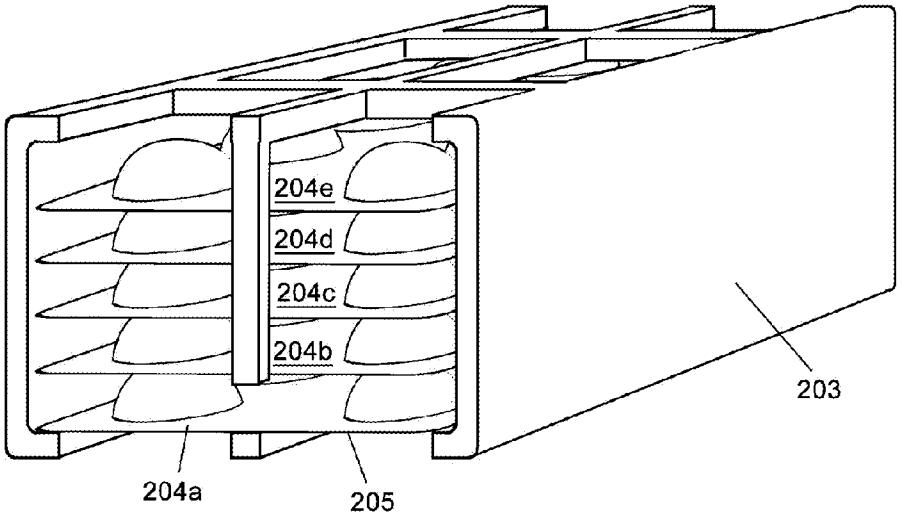
Figure 10:
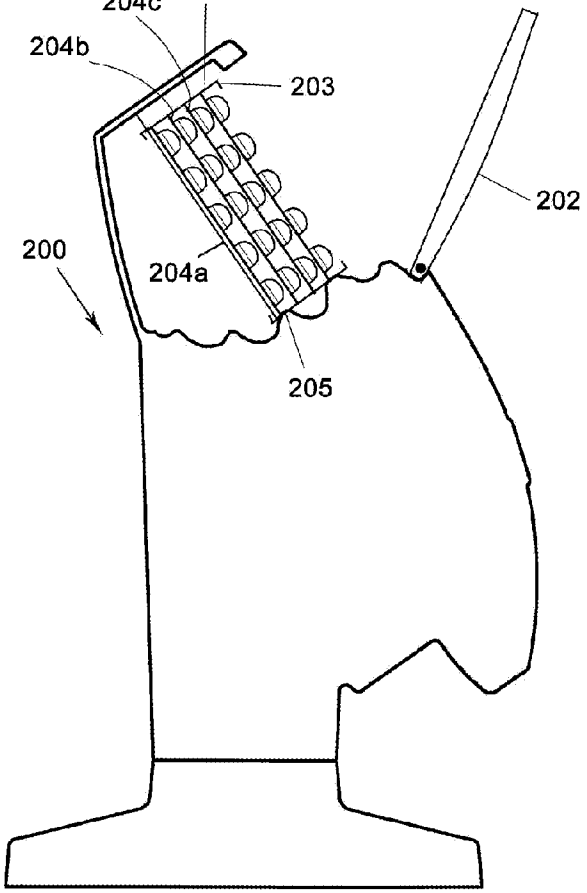

FIG. 10 shows a side cross-sectional view of a dispenser of the present invention with a front opening and a cassette with multiple blister packs inserted therein; and FIG. 11 shows a side perspective view of a cassette containing a plurality of standard blister packs for use in the dispenser of FIG. 10.

DETAILED DESCRIPTION OF THE PREFERRED EMBODIMENTS

Figure 1A:
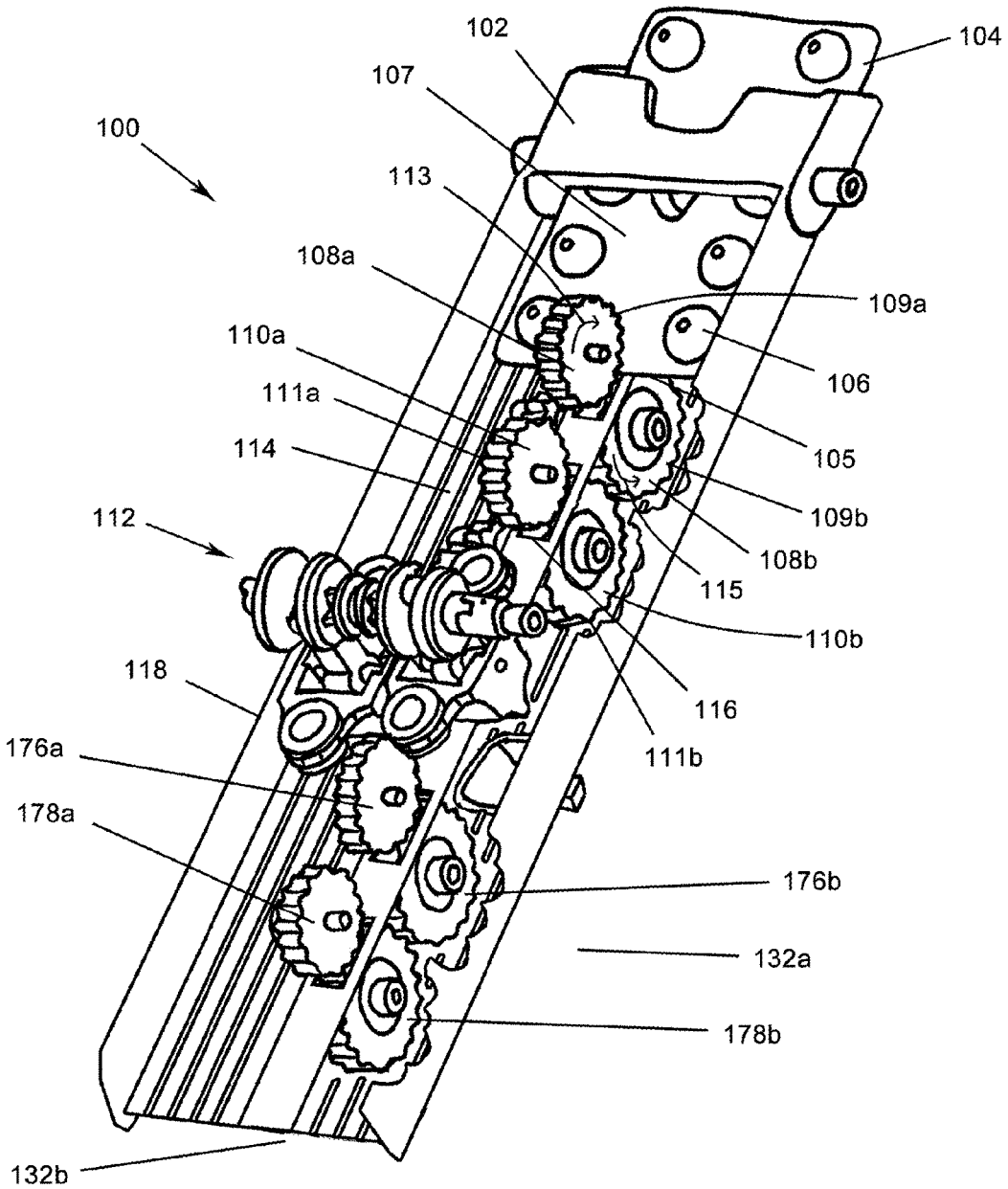
FIG. 1*a* shows the internal components of a first embodiment of the present invention, in a front perspective view.

A preferred embodiment of the medication dispenser of the present invention is shown in a front perspective view in FIG. 1*a*, generally designated by numeral (100), wherein the outer housing is removed to show the internal components of dispenser (100). Dispenser (100) comprises an access portal (102) through which a blister pack (104) is inserted. Blister pack (104) is preferably a standard flat multiple pill-containing pack of the double arrayed blister package type, having two columns and a plurality of rows of pills (106). An authorized medical person manually inserts blister pack (104) through access portal (102) until distal edge (105) of blister pack (104) is received by a pair of electromechanical driving wheels (108*a*), (108*b*), which are preferably spur gears, as shown in the figures.

In a preferred embodiment, a second pair of driving wheels (110*a*), (110*b*) is present, for advancing blister pack (104) toward the depilling station (112), as described in greater detail herein below.

Still referring to FIG. 1*a*, driving wheels (108*a*), (108*b*) and (110*a*), (110*b*) are positioned lengthwise along the central longitudinal axis of a blister pack support means, preferably comprising a surface (114) along which blister pack (104) is conveyed. Upper wheels (108*a*), (110*a*) are situated above surface (114) and lower wheels (108*b*), (110*b*) are situated below surface (114). Surface (114) is shown in FIG. 1 partially cut out in order to view lower wheels (108*b*), (110*b*). Longitudinally spaced openings (116) in surface (114) enable gear teeth (109*a*), (109*b*) and (111*a*), (111*b*) to mesh.

Figure 1B:
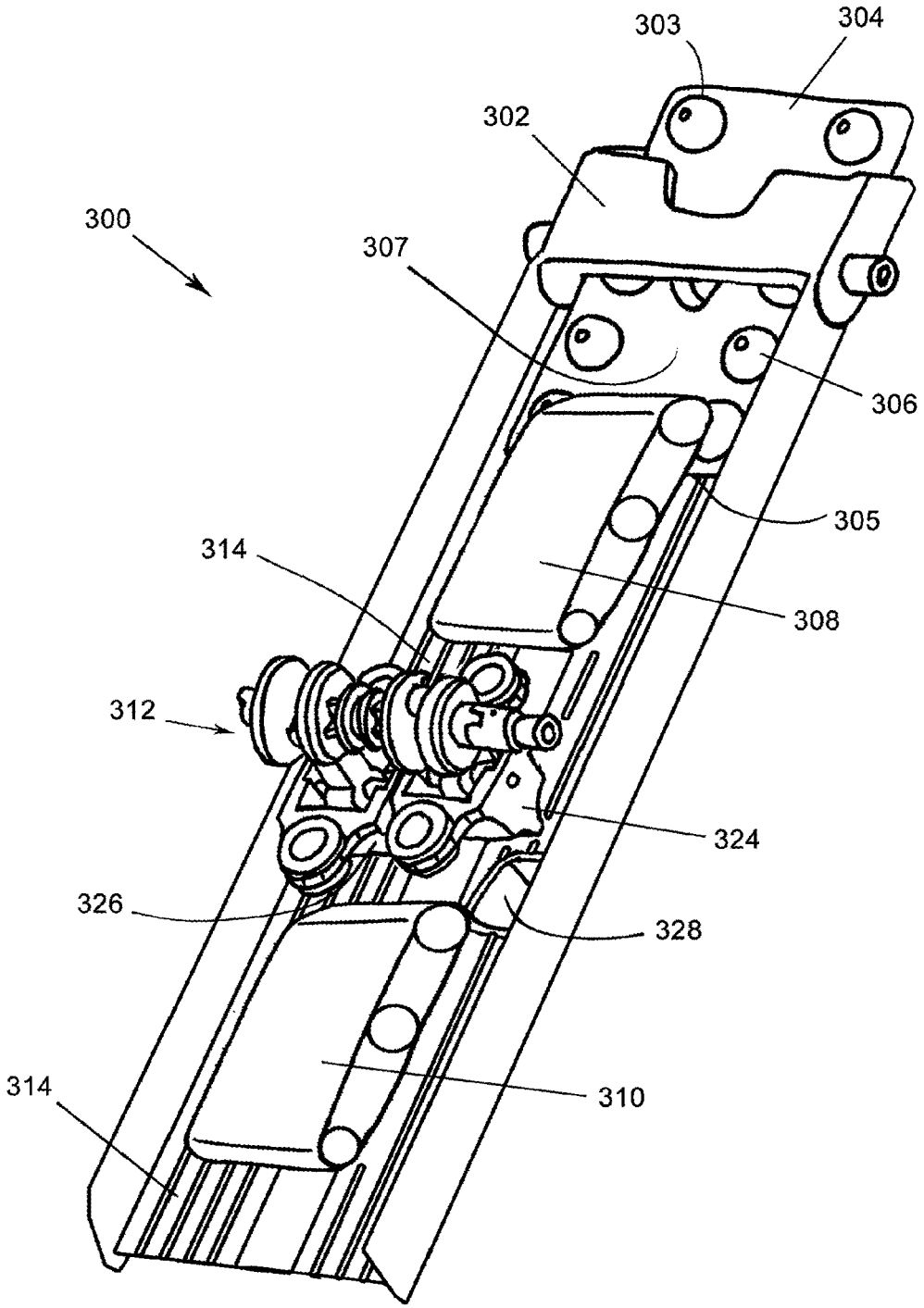
FIG. 1*b* shows the internal components of a second embodiment of the present invention, in a front perspective view.

A further preferred embodiment of the medication dispenser of the present invention is shown in a front perspective view in FIG. 1*b*, generally designated by numeral (300), wherein the outer housing is removed to show the internal components of dispenser (300). Dispenser (300) comprises an access portal (302) through which a blister pack (304) is inserted. Blister pack (304) is preferably a flat multiple pill-containing pack of the blister package type, having at least one column (303) and a plurality of rows (307) of pills (306). An authorized medical person manually inserts blister pack (304) through access portal (302) until distal edge (305) of blister pack (304) is received by an electromechanical blister pack advancing unit, which in this embodiment, is a conveyor belt (308) as shown in the figure, for advancing blister pack (304) toward the depilling station (302), as described in greater detail herein below with reference to FIG. 3.

Still referring to FIG. 1*b*, electromechanical conveyor belt (308) is positioned lengthwise along the central longitudinal axis of a blister pack support means, preferably comprising a surface (314) along which blister pack (304) is conveyed. Conveyor belt (308) is above surface (314) which surface is partially cut out in order to view pill receiving aperture (328).

Following the depilling of one or more pills (306) in a row (307) of blister pack (304), conveyor belt (308) is activated via a pill detecting means situated at depilling station (312), as described herein. Conveyor belt (308) rotates until the pill detecting means determines that at least one pill is present in the next row of pills. One or both of depilling press means (324), (326) is then actuated as described below with reference to press means (124) and (126) in FIGS. 3 and 4.

As blister pack (304) is depilled and continues past depilling station (312), in a preferred embodiment, secondary conveyor belt (310) having the same configuration and rotational direction as that of conveyor belt (308), mutatis mutandis, is situated further longitudinally along the central longitudinal axis of surface (314). Conveyor belt (310) receives blister pack (304) and continues to advance blister pack (304) out of exit slot (180) (FIG. 9) once all pills have been depilled from blister pack (304) or until blister pack (304) is no longer required.

The empty blister pack (304) may be discarded. If any pills remain in the blister pack (304) and the pills are considered a controlled drug, the pills are then returned to a secure location and the number of pills that are being returned is recorded.

Figure 2B:
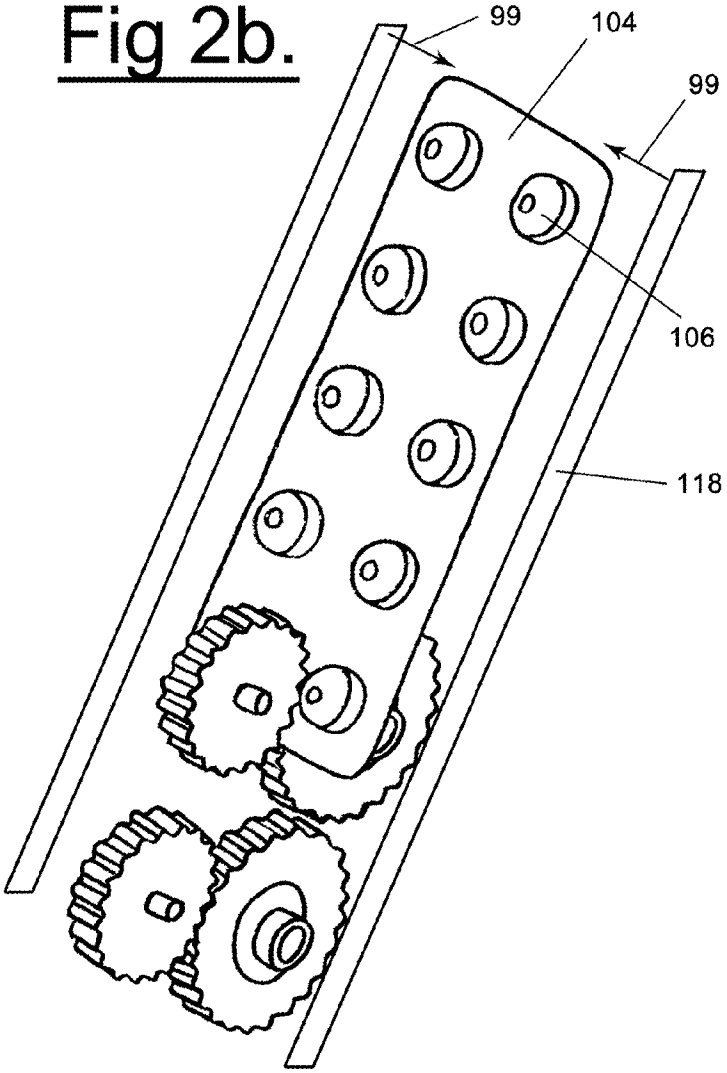
FIGS. 2*a* and 2*b* show an enlarged close-up of driving wheels with a wide blister pack (FIG. 2*a*) and a narrow blister pack (FIG. 2*b*) in a front perspective view.
Figure 2A:
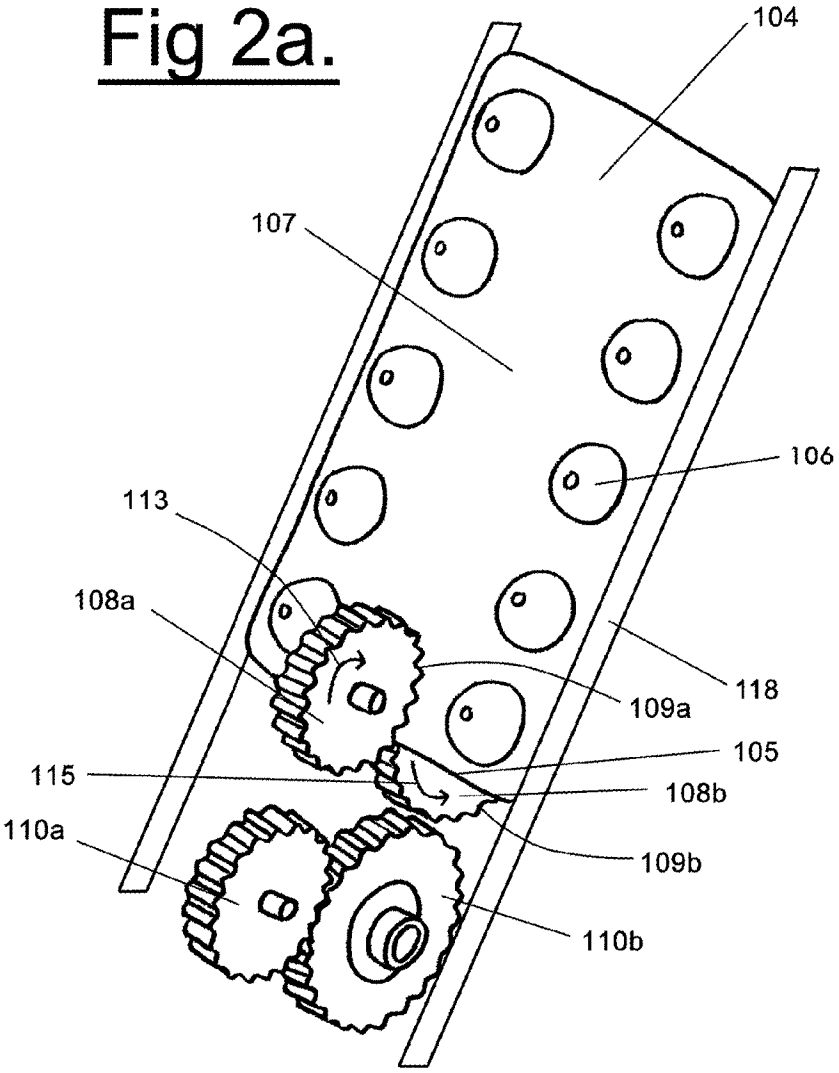

FIG. 2*a* shows an enlarged close-up of blister pack (104) and driving wheels (108*a*), (108*b*) and (110*a*), (110*b*) in a front perspective view. With reference to both FIG. 1 and FIG. 2*a*, when driving wheels (108*a*), (108*b*) receive distal edge (105) of blister pack (104) between the two columns of pills, a blister pack sensor (not shown) detects the presence of blister pack (104) and initiates the rotation of driving wheels (108*a*), (108*b*). Driving wheel (108*a*) rotates about its central axis in the clockwise direction as indicated by arrow (113), and driving wheel (108*b*) rotates about its central axis in the counterclockwise direction as indicated by arrow (115). Upon rotation of driving wheels (108*a*), (108*b*), distal edge (105) is caught between the teeth (109*a*), (109*b*) of driving wheels (108*a*), (108*b*). As driving wheels (108*a*), (108*b*) continue to rotate, blister pack (104) is conveyed along surface (114), with driving wheels (108*a*), (108*b*) and (110*a*), (110*b*) disposed between and aligned parallel with the two columns of pills. Driving wheels (110*a*), (110*b*) rotate in the same manner as driving wheels (108*a*), (108*b*). Driving wheels (108*a*), (108*b*) and (110*a*), (110*b*) are mechanically linked, preferably by at least one driving motor (not shown), in order to rotate concurrently with each other. Teeth (109*a*) and (109*b*), and (111*a*) and (111*b*) of respective driving wheels (108*a*), (108*b*) and (110*a*), (110*b*) are fitted closely together such that they bite the flat central portion (107) of blister pack (104) to prevent slippage as blister pack (104) advances toward depilling station (112).

Additionally, surface (114) comprises side rails (118) for assisting to maintain the two columns of pills aligned in parallel with driving wheels (108*a*), (108*b*) and (110*a*), (110*b*), particularly with regards to blister packs (104) that have wide flat portions (see FIG. 2*a*). Side rails (118) are optionally transversely adjustable for accommodating both wide and narrow blister packs (104) as indicated by the inward pointing arrows (99) (see FIG. 2*b*).

According to a preferred embodiment, access door (102) is shut and locked upon the complete insertion of blister pack (104). Additionally, access door (102) is preferably designed such that blister pack (104) is only able to pass therethrough when oriented in the proper direction, i.e. when the blisters are faced upward.

Figure 3:
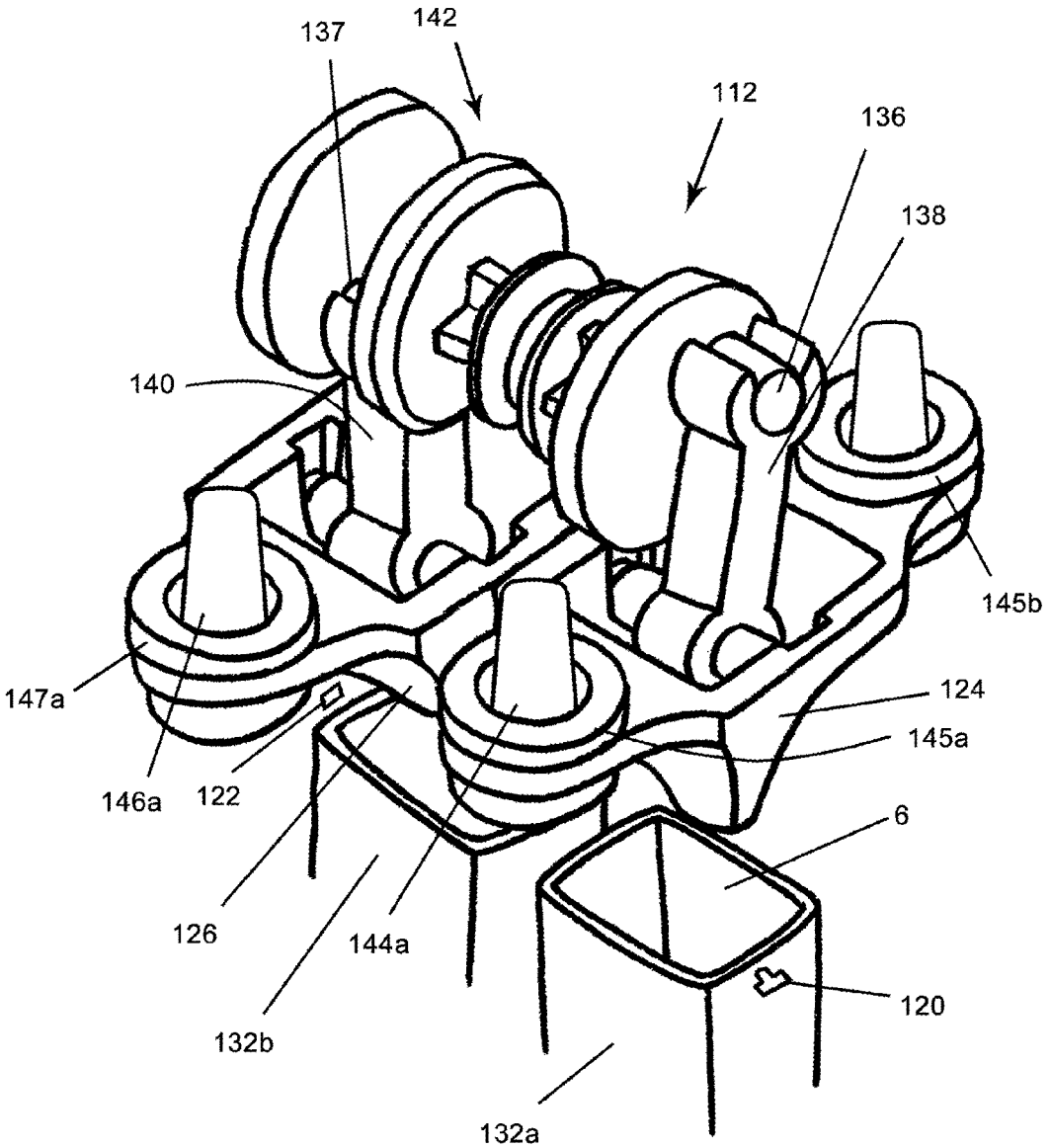
FIG. 3 shows the depilling station and channels of the present invention in a front perspective view.
Figures 4, 5:
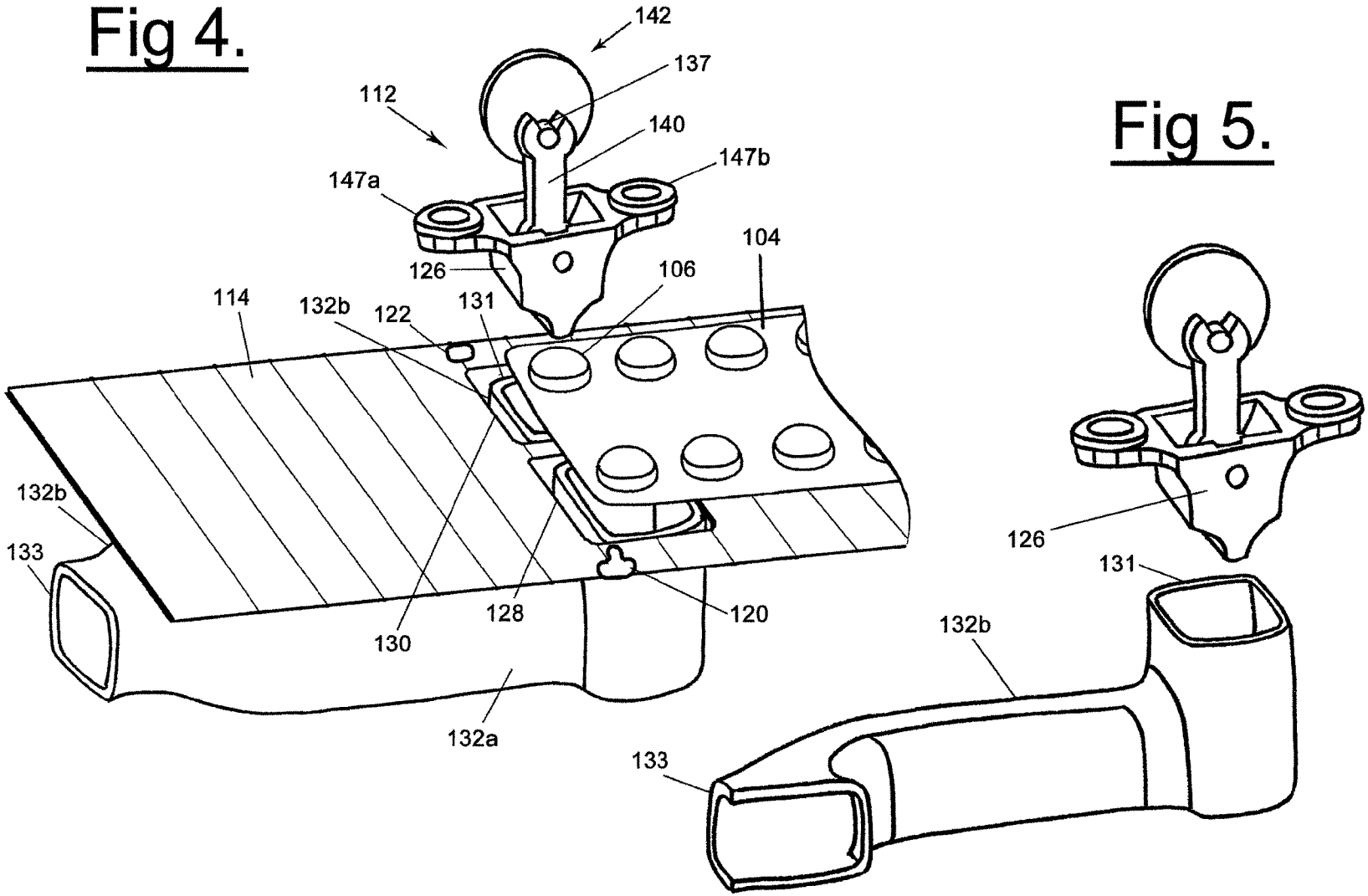
FIG. 4 shows a blister pack, channels, one depilling means and the blister pack support means in a side perspective view.
FIG. 5 shows one depilling means and a channel in a side perspective view.

Referring to FIG. 3 in combination with FIG. 4, depilling station (112) and channels (132*a*), (132*b*) are shown in FIG. 3, and surface (114), blister pack (104), channels (132*a*), (132*b*) and one depilling means (126) are shown in FIG. 4, wherein the other components of the dispenser are removed for clarity. As blister pack (104) reaches depilling station (112) a pill detecting means, comprising a sensor system having, for instance, an IR, a laser source (120) and a detector (122), or any other detection system situated on opposing longitudinal sides of blister pack (104) to determine whether at least one pill is present in the first row of pills. If at least one pill is present, at least one depilling press means (124), (126) of depilling station (112) is activated, for forcing one pill at a time from its blister out of the flat backing of blister pack (104), through pill receiving apertures (128), (130) of surface (114), as described in greater detail herein below.

As seen in FIG. 4 and as mentioned briefly above, two transversally spaced pill receiving apertures (128), (130) through which pills from blister pack (104) pass are situated in surface (114). Each aperture (128), (130) is large enough and is spaced apart from the other at a distance that would allow pills of various sizes and shapes to pass therethrough. Moreover, since blister packs come in different sizes, wherein the parallel columns of pills of some blister packs are spaced closer together than or farther apart from other blister packs, apertures (128), (130) are designed to allow pills from a wide variety of blister pack dimensions to pass therethrough.

With reference again to FIG. 3 and FIG. 4, depilling press means (124), (126) are essentially a pair of pistons transversely spaced apart from each other and aligned above respective apertures (128), (130). Press means (124), (126) are selectively raised and lowered by a depilling motor (not shown), preferably via crankshafts (136), (137), connecting rods (138), (140) and eccentrically coupled cam shaft (142).

As best seen in FIG. 3 the present invention comprises a guide means for maintaining depilling press means (124), (126) normally aligned with surface (114). The guide means comprises a pair of elongated guide elements (144*a*), (144*b*) and (146*a*), (146*b*) respectively, wherein each guide element is integrally joined with surface (114) (not shown in the figure), extending orthogonally therefrom. Each guide element (144*a*), (144*b*) is longitudinally spaced apart from its corresponding pair (146*a*), (146*b*), on opposing longitudinal sides of respective apertures (not shown in the figure). A ring element (145*a*), (145*b*) and (147*a*), (147*b*) extends from each longitudinal end of each depilling press means (124), (126), wherein opposing pairs of ring elements (145*a*), (145*b*) and (147*a*), (147*b*) are disposed around opposing pairs of rods (144*a*), (144*b*) and (146*a*), (146*b*), respectively. Thus, when depilling press means (124), (126) are raised and lowered, ring elements (145*a*), (145*b*) and (147*a*), (147*b*) shiftingly slide along rods (144*a*), (144*b*) and (146*a*), (146*b*) in the normal direction.

The depilling motor for selectively raising and lowering press means (124), (126) is programmed to rotate in a first direction for activating first press means (124) to thereby dispense a first pill from blister pack (104), and to rotate in the opposite direction for activating second press means (126) to thereby dispense a second pill from blister pack (104). Alternatively, the depilling motor may be rotated in a single direction, whereby upon the lowering of first press means (124), second press means (126) is raised, and vice versa.

In operation, once it is determined that, for instance, second depilling means (126) is positioned above a blister containing a pill (106) (see FIG. 4), the depilling motor is actuated and depilling means (126) is lowered, thereby pushing pill (106) out of its blister through pill receiving aperture (130) into channel (132*b*). Referring to FIG. 4 as well as to FIG. 5, which shows only depilling means (126) and channel (132*b*) for clarity, the inlet (131) of channel (132*b*) is disposed beneath aperture (130), and the outlet (133) of channel opens into a pill dispensing receptacle (134) (see FIG. 1) via a one-way valve (not shown) that allows only one pill at a time to pass therethrough. In a preferred embodiment, two independent channels (132*a*), (132*b*) are present, wherein the inlet of each channel is disposed beneath and aligned with each respective aperture (128) (130), as can be seen in the figures. Alternatively, a single channel is present, having two inlets, one disposed beneath and aligned with one of each aperture (128), (130).

Figure 6:
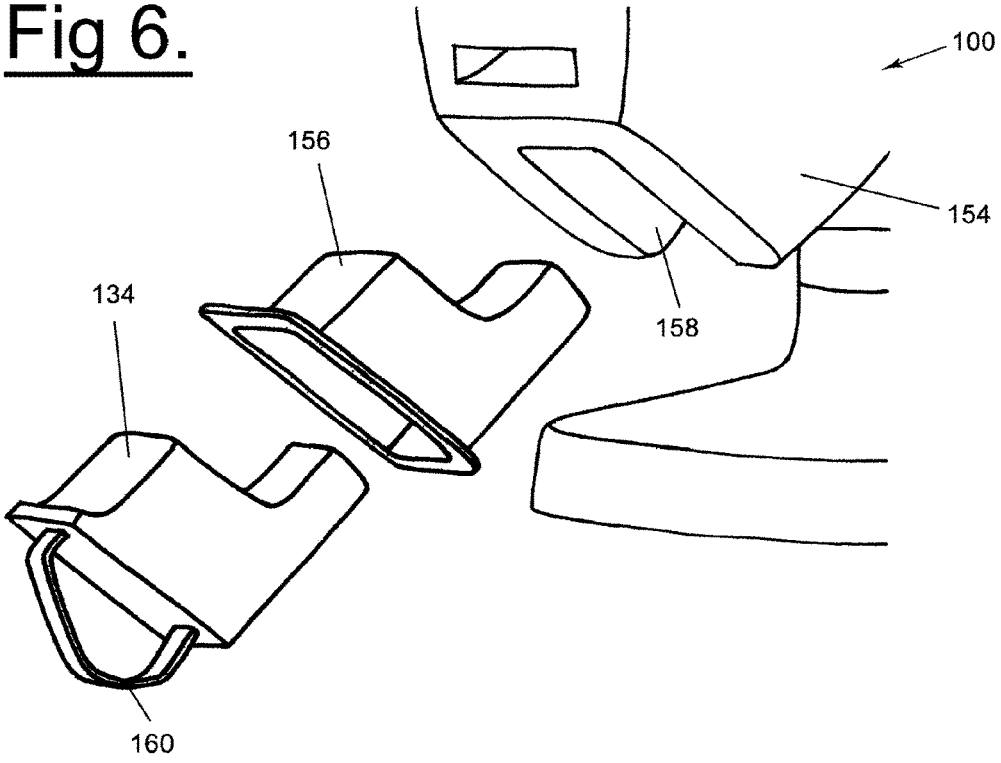
FIG. 6 shows the components of the bottom of the dispenser of the present invention in an exploded view.

Referring to FIG. 6, the components of the bottom portion of dispenser (100) (enclosed by outer housing (154)) are shown in an exploded view, showing receptacle (134) and an integral housing (156). Housing (156) covers receptacle (134) as seen assembled in FIG. 1 and is securable to dispenser (100) within opening (158) in a locking engagement.

Figure 6A:
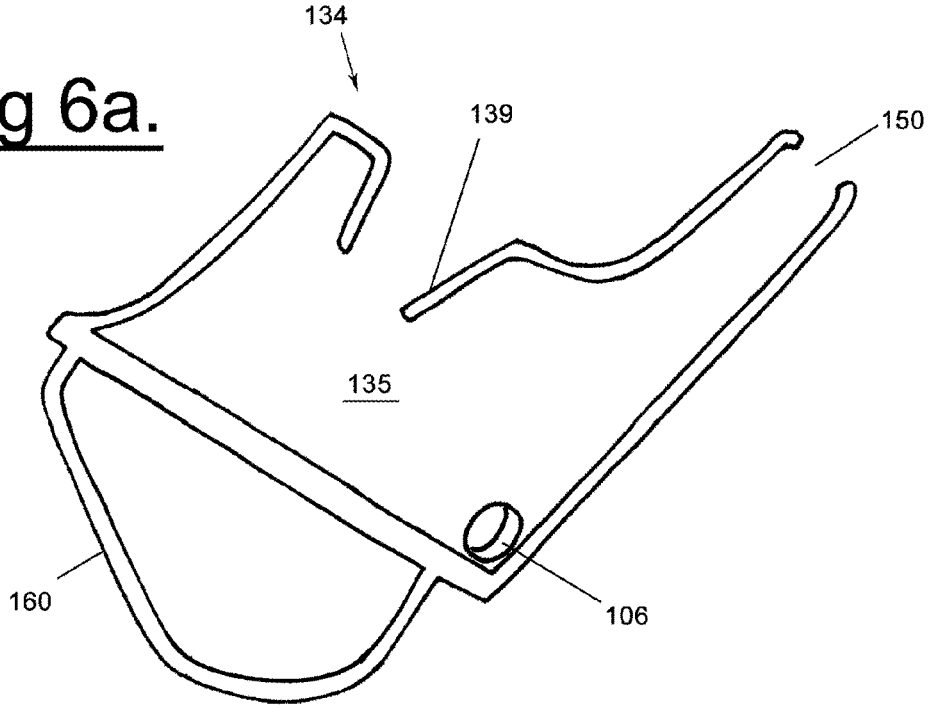
FIG. 6*a* shows the pill receptacle in a side cross-sectional view cut across its longitudinal axis

Referring to FIG. 6*a*, a receptacle (134) is shown in a cross-sectional side view cut across its longitudinal axis, comprising a compartment (135) for accommodating pill (106). Pill (106) enters compartment (135) through opening (139), from the outlet of a channel (not shown in the figure). Receptacle (134) comprises a pill receptacle detection means (not shown) for determining whether a pill is present within receptacle (134). The pill receptacle detection means is electromechanically connected with depilling press means (124), (126) for enabling the activation of one of depilling press means (124), (126) only when receptacle (134) is empty. Pill (106) is dispensed to the patient through opening (150) by tilting receptacle (134) using handle (160).

Figure 7:
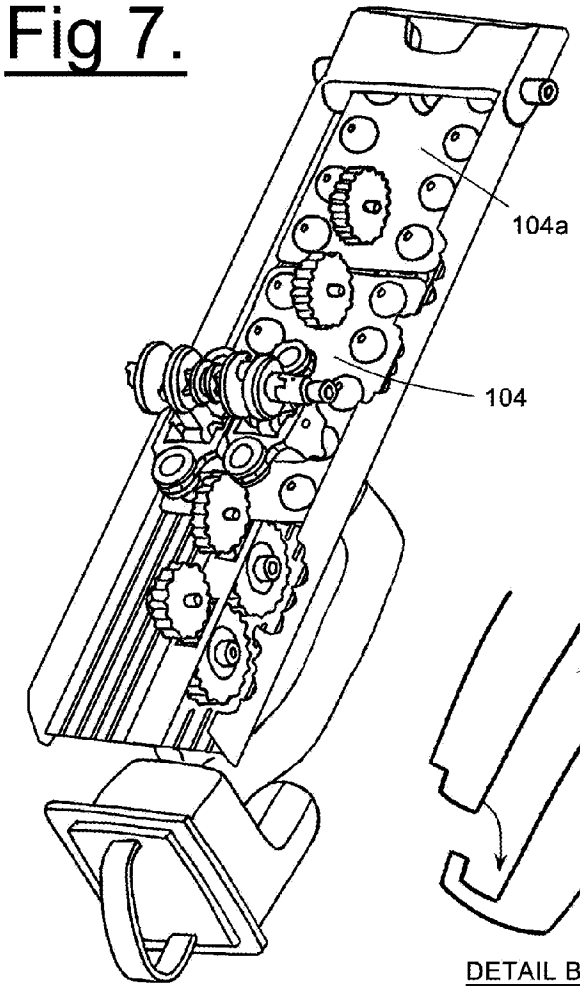
FIG. 7 shows the internal components of the present invention, in a front perspective view with two blister packs in the dispenser.

Referring to FIG. 7, a preferred embodiment of the medication dispenser of the present invention is shown in a front perspective identical to FIG. 1, except that blister pack 104 is shown as having partially advanced through the depilling station (112) creating room in the dispenser for an authorized medical person to manually insert a second blister pack (104*a*) through access door (102), Referring back to FIG. 1*a*, following the depilling of both pills in a row of blister pack (104), the transmission motor that drives driving wheels (108*a*), (108*b*) and (110*a*), (110*b*) is activated via the pill detecting means situated at depilling station (112), as described herein above. Driving wheels (108*a*), (108*b*) and (110*a*), (110*b*) rotate until the pill detecting means determines that at least one pill is present in the next row of pills. One or both of depilling press means (124), (126) is then actuated as described herein above.

As blister pack (104) is depilled and continues past depilling station (112), in a preferred embodiment, secondary driving wheels (176*a*), (176*b*) and (178*a*), (178*b*) having the same configuration and rotational directions as that of driving wheels (108*a*), (108*b*) and (110*a*), (110*b*), mutatis mutandis, are situated further longitudinally along the central longitudinal axis of surface (114). Secondary driving wheels (176*a*), (176*b*) and (178*a*), (178*b*) receive distal edge (105) of blister pack (104) between the two columns of pills and continue to advance blister pack (104) out of exit slot (180) (FIG. 9) once all pills have been depilled from blister pack (104) or until blister pack (104) is no longer required.

The empty blister pack (104) may be discarded. If any pills remain in the blister pack (104) and the pills are considered a controlled drug, the pills are then returned to a secure location and the number of pills that are being returned is recorded.

Following the completion of the prescription of a pill medication to a patient, residue from the previous medication may be left within receptacle (134) of dispenser (100). Particularly regarding controlled drugs, it is important that even leftover pill residue is not easily accessible. Furthermore any such residue is contaminated by contact with the mouth and/or breath of the previous patient Instead of removing receptacle (134) in order to empty and clean, it is desirable for the entire receptacle (134) and housing (156) to be removed and discarded. Preferably, the separation of housing (156) from dispenser (100) requires breakage of housing (156), rendering housing (156) and receptacle (134) unsuitable for reuse.

After removing housing (156) and receptacle (134), as seen in FIG. 6, replacement housing and receptacle components (not shown) may be inserted to into opening (158) of dispenser (100) and locked thereto to be used by a different patient.

Referring to FIG. 8, showing a side perspective view of the assembled dispenser (100) comprising an outer housing (154) formed from a split housing having a first component (162) and a second component (164), each of which is provided with at least one mutually interengaging peripheral edge (167), (169) as shown in enlarged detail B. Alternatively as shown enlarged in Detail A, a plurality of engagement means (170) is Optionally spaced around peripheral edge (166) of first component (162) for slidingly interlocking with a complementary engaging means (172) spaced around peripheral edge (168) of second component (164) to form a closed outer housing (154). Latch means (174) prevents the disengagement of first and second components (162), (164) from each other. Latch means (174) is associated with access door (102), whereby both are openably coded by microprocessor means associated therewith.

Referring to FIGS. 8 and 9, the assembled dispenser (100) is shown in side perspective (FIG. 8) and front perspective (FIG. 9) views mounted on a stand (182) comprising a leg (184) and a base (186) for positioning on a flat surface near the patient. Dispenser (100) enables the controlled sequential delivery of a regimen of pills on an as-needed basis with a predetermined prescribed minimum time interval between delivery of each pill. To that end, a digital display (103) indicates pertinent information such as the current time, time remaining until next depilling, type of pill within dispenser (100), number of pills depilled, number of pills remaining, etc. Preferably, an alarm is sounded, or any alternative audio or visual signal is generated when the time for the patient to take another pill has arrived. Settings of dispenser (100), such as regulating the time interval between the depilling of pills may be controlled directly by using digital display (103) as a touchpad. Alternatively, control buttons (not shown) either on or around digital display (103) enable the user to electronically control dispenser settings. Hence, after the nurse configures the settings of dispenser (100), dispenser (100) may be kept in the patient's room, requiring no further input from the nurse until blister pack (104) or the prescription is completed.

In some embodiments a window (not shown) enables the user, including both the patient and the nurse, to view the portion of blister pack (104), or the entire blister pack (104) situated within outer housing (154) of dispenser (100), to visually determine if and how many pills remain in blister pack (104).

Referring to FIG. 10 there is seen a side cross-sectional view of a dispenser (200) of the present invention with a front opening door (202) and a cassette (203) (as more clearly seen in FIG. 11) with multiple blister packs (204*a-d*) inserted therein.

It is to be understood that in a similar manner as described with reference to FIG. 1 and FIG. 2*a*, driving wheels (108*a*), (108*b*) (not seen in FIG. 10) receive the distal edge (205) of the lowermost blister pack (204*a*) in cassette (203) between the two columns of pills, and a blister pack sensor (not shown) detects the presence of such a lowermost blister pack (204*a*, 204*b*, 204*c*, and 204*d* in turn) and initiates the rotation of driving wheels (108*a*), (108*b*) whereafter each blister pack (204*a*, 204*b*, 204*c*, and 204*d*) is advanced in turn to depilling station (112) for individual depilling as described herein with reference to the previous Figures.

Referring to FIG. 11 there is seen a side perspective view of the cassette (203) containing a plurality of standard blister packs (204*a*, 204*b*, 204*c*, 204*d* and 204*e*) for use in the dispenser (200) of FIG. 10.

It is to be understood that while a specific blister in a blister pack normally and preferably contains only one pill to be dispensed, it is possible to prepare blister packs with more than one pill per blister when a regimen of providing two or more pills simultaneously is prescribed.

It is understood that the above description of the embodiments of the present invention are for illustrative purposes only, and is not meant to be exhaustive or to limit the invention to the precise form or forms disclosed, as many modifications and variations are possible. Such modifications and variations are intended to be included within the scope of the present invention as defined by the accompanying claims.

What is claimed is:

1. A medication dispenser enabling a controlled sequential delivery of a regimen of pills on an as-needed basis with a predetermined prescribed minimum time interval between delivery of each pill, from any standard flat multiple pill-containing pack of the double arrayed blister package type having two columns and a plurality of rows of pills to be dispensed, said medication dispenser comprising:

a) an access portal sized to receive at least one any such blister pack and to guide said pack to at least one pair of electromechanical driving wheels which in turn sequentially advance said pack to a stationary depilling station, said station comprising:

i. pill detecting means;

ii. a blister pack support having two spaced-apart pill receiving apertures, each aperture being sized and positioned to receive pills of different sizes, shapes and spacing in said blister pack array; and, iii. electromechanical depilling press means positioned, upon activation, to force at least one pill at a time from its respective blister through the backing of said blister via one of said apertures as said blister pack is advanced through said stationary depilling station within said medication dispenser;

wherein the pair of depilling press means are activated by a depilling motor operationally linked thereto such that said motor is programmed to rotate in one direction to activate a first of said press means to dispense one of the pills and said motor is programmed to rotate in the opposite direction to activate a second of said press means to dispense another of said pills in said row.

2. A medication dispenser according to claim 1, further comprising:

a) a channel into which said pill enters from said apertures; and, b) a dispensing receptacle for receiving said pill from said channel.

3. A medication dispenser according to claim 1, wherein said depilling motor operates in conjunction with a crankshaft apparatus which in turn directs separate up and down motion of each of said pair of depilling press means relative a positioned row of pills in said blister pack.

4. A medication dispenser according to claim 1, further comprising guide means to direct up and down motion of said pair of depilling press means relative a positioned row of pills in said blister pack.

5. A medication dispenser according to claim 1, wherein said medication dispenser is provided with at least two guide means for aligning said blister pack as it is advanced by said at least one pair of electromechanical driving wheels to said depilling station, said guide means including a first guide comprising wheels and spacers which use the two columns of pills themselves for aligning said blister pack as it is advanced and a second guide which interacts with the longitudinal side edges of the blister pack for aligning said blister pack as it is advanced within said medication dispenser.

6. A medication dispenser according to claim 1, wherein said pair of electromechanical depilling press means comprise a pair of pistons transversely spaced apart from each other.

* * * * *